US008387707B2

(12) United States Patent
Adamek et al.

(10) Patent No.: US 8,387,707 B2
(45) Date of Patent: Mar. 5, 2013

(54) BELLOWS TYPE ADJUSTABLE CASING

(75) Inventors: Frank C. Adamek, Spring, TX (US); James R. M. Allison, Cypress, TX (US)

(73) Assignee: Vetco Gray Inc., Houston, TX (US)

( * ) Notice: Subject to any disclaimer, the term of this patent is extended or adjusted under 35 U.S.C. 154(b) by 436 days.

(21) Appl. No.: 12/332,817

(22) Filed: Dec. 11, 2008

(65) Prior Publication Data

US 2010/0147530 A1 Jun. 17, 2010

(51) Int. Cl.
*E21B 17/01* (2006.01)

(52) U.S. Cl. ..... 166/367; 166/338; 166/355; 166/346

(58) Field of Classification Search ..... 166/385, 166/339, 350–355, 367; 405/224.2–224.4
See application file for complete search history.

(56) References Cited

U.S. PATENT DOCUMENTS

| | | | | |
|---|---|---|---|---|
| 993,934 | A * | 5/1911 | Witzenmann | 285/114 |
| 3,105,509 | A * | 10/1963 | Moore, Jr. | 137/102 |
| 3,168,334 | A * | 2/1965 | Johnson | 285/55 |
| 3,477,507 | A * | 11/1969 | Page, Jr. | 166/322 |
| 3,612,176 | A * | 10/1971 | Bauer et al. | 166/359 |
| 3,876,235 | A * | 4/1975 | Flint | 285/93 |
| 4,072,329 | A * | 2/1978 | Mutchler | 285/187 |
| 4,176,863 | A | 12/1979 | Wetmore | |
| 4,195,865 | A | 4/1980 | Martin | |
| 4,278,277 | A | 7/1981 | Krijgsman | |
| 4,548,273 | A | 10/1985 | Leicht et al. | |
| 4,564,068 | A * | 1/1986 | Baugh | 166/123 |
| 4,598,936 | A | 7/1986 | Doll et al. | |
| 4,624,318 | A * | 11/1986 | Aagaard | 166/359 |
| 4,761,023 | A | 8/1988 | Troxell, Jr. | |
| 4,819,967 | A | 4/1989 | Calder et al. | |
| 5,407,237 | A * | 4/1995 | Smolowitz | 285/31 |
| 5,556,679 | A * | 9/1996 | Booles | 428/36.91 |
| 6,484,801 | B2 * | 11/2002 | Brewer et al. | 166/65.1 |
| 6,513,837 | B2 | 2/2003 | Fujikawa et al. | |
| 6,854,930 | B2 * | 2/2005 | Pionetti | 405/172 |
| 7,114,885 | B2 * | 10/2006 | Loset et al. | 405/224.2 |
| 7,188,677 | B2 * | 3/2007 | Moe | 166/355 |
| 7,341,283 | B2 * | 3/2008 | Moses et al. | 285/226 |
| 7,654,315 | B2 * | 2/2010 | Du et al. | 166/105 |
| 2007/0074872 | A1 * | 4/2007 | Du et al. | 166/369 |
| 2008/0247719 | A1 * | 10/2008 | Cody et al. | 385/114 |

(Continued)

FOREIGN PATENT DOCUMENTS

| | | | |
|---|---|---|---|
| CN | 101333917 | A | 12/2008 |
| EP | 2180133 | A1 | 4/2010 |

OTHER PUBLICATIONS

GB Search Report dated Feb. 2, 2012 from corresponding Application No. GB1120136.5.

*Primary Examiner* — Thomas Beach
*Assistant Examiner* — Aaron Lembo
(74) *Attorney, Agent, or Firm* — Bracewell & Giuliani LLP

(57) ABSTRACT

A tieback connection between an offshore production platform and a wellhead on the sea floor has a riser and a tubular expandable and contractable member within the riser. The expandable and contractable member compensates for axial movement within the riser while maintaining axial tension in the riser. The expandable and contractable member is of unibody construction having a wall configured to correspondingly expand and contract to compensate for the riser movement. In cross section, the member wall comprises folds formable by alternating slots formed into the inner and outer wall surface or an undulating surface.

14 Claims, 4 Drawing Sheets

U.S. PATENT DOCUMENTS

2009/0200025 A1* 8/2009 Bravo ..... 166/265
2010/0024911 A1* 2/2010 Menardo et al. ..... 138/112
2010/0084035 A1* 4/2010 Binet et al. ..... 138/104
2010/0147530 A1 6/2010 Adamek et al.
2010/0175882 A1* 7/2010 Bailey et al. ..... 166/335
2010/0183371 A1* 7/2010 Witz ..... 405/171
2010/0269942 A1* 10/2010 Lee ..... 138/109
2010/0288505 A1* 11/2010 Brown ..... 166/346
2011/0005769 A1* 1/2011 Robichaux et al. ..... 166/358
2011/0052328 A1* 3/2011 Frerich et al. ..... 405/224.2
2011/0067880 A1* 3/2011 Adamek ..... 166/345

* cited by examiner

BELLOWS TYPE ADJUSTABLE CASING

BACKGROUND

1. Field of Invention

The device described herein relates generally to the production of oil and gas. More specifically, the device described herein relates to an expandable and/or contractable tensioning device for a tie-back assembly.

2. Description of Related Art

Some offshore platforms have a production tree or trees above the sea surface on the platform. In this configuration, a casing string extends from the platform housing to a subsea wellhead housing disposed on the seafloor. Production casing inserted within the wellbore is supported on the subsea floor by a hanger in the subsea housing. The casing string between the subsea and surface wellhead housings is tensioned to prevent flexure that may be caused by thermal expansion from heated wellbore fluids or vibration from applied side loads. Additionally, the string length or height is typically adjusted to seat or land the upper casing hanger within a surface wellhead.

A sub assembly can be attached to the casing string and used to tension the casing string and adjust its length. The sub assemblies typically comprise a pair of mated housings that in response to an applied force are mechanically retractable in length The adjustable sub assemblies connect inline within the string or on its upper end and when retracted impart a tension force on the casing string and by its retraction, shortening the casing string length.

SUMMARY OF INVENTION

Disclosed herein is a tubular assembly for connection between a platform and a subsea wellhead assembly. In one embodiment the tubular assembly comprises an annular riser for connection between the platform and the subsea wellhead assembly and an axially expandable and contractable member connected to the annular riser. The expandable and contractable member includes a tubular having a wall formed to axially expand and contract a greater amount per linear increment than the riser. The tubular can be formed from a unibody construction. When expanding and contracting, the expandable and contractable member wall maintains an axial force therein. The wall may include a series of slots along the wall length alternatingly formed about the wall inner circumference and about the wall outer circumference, each slot lying in a plane substantially perpendicular to the member axis. Alternatively, the member wall may be made up of annular foldable segments coaxially stacked along the member axis. The foldable segments may have an "S" shaped cross section and the segment outer and inner diameter can vary along the member axis length. The wall may have a bellows like shape. A helix formed in the member may selectively shape the wall.

Also disclosed herein is a method of connecting a subsea wellhead assembly and a surface platform. The method may involve providing an axially expandable tubular member, connecting the tubular member into a riser extending between the subsea wellhead assembly and the surface platform, and applying tension to the riser and the tubular member, the tubular member being more expandable per linear increment than the riser.

In the present art of adjustable subs, there exists a plurality of seal elements to accommodate the lengthening or shortening of the casing string. The device described herein eliminates the need for sliding seal elements and hence the design can be used for higher elevated temperatures and pressures of the produced fluids or gases. Alternately, the bellows type sub will accommodate higher temperature injection of liquids or gases into a reservoir.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
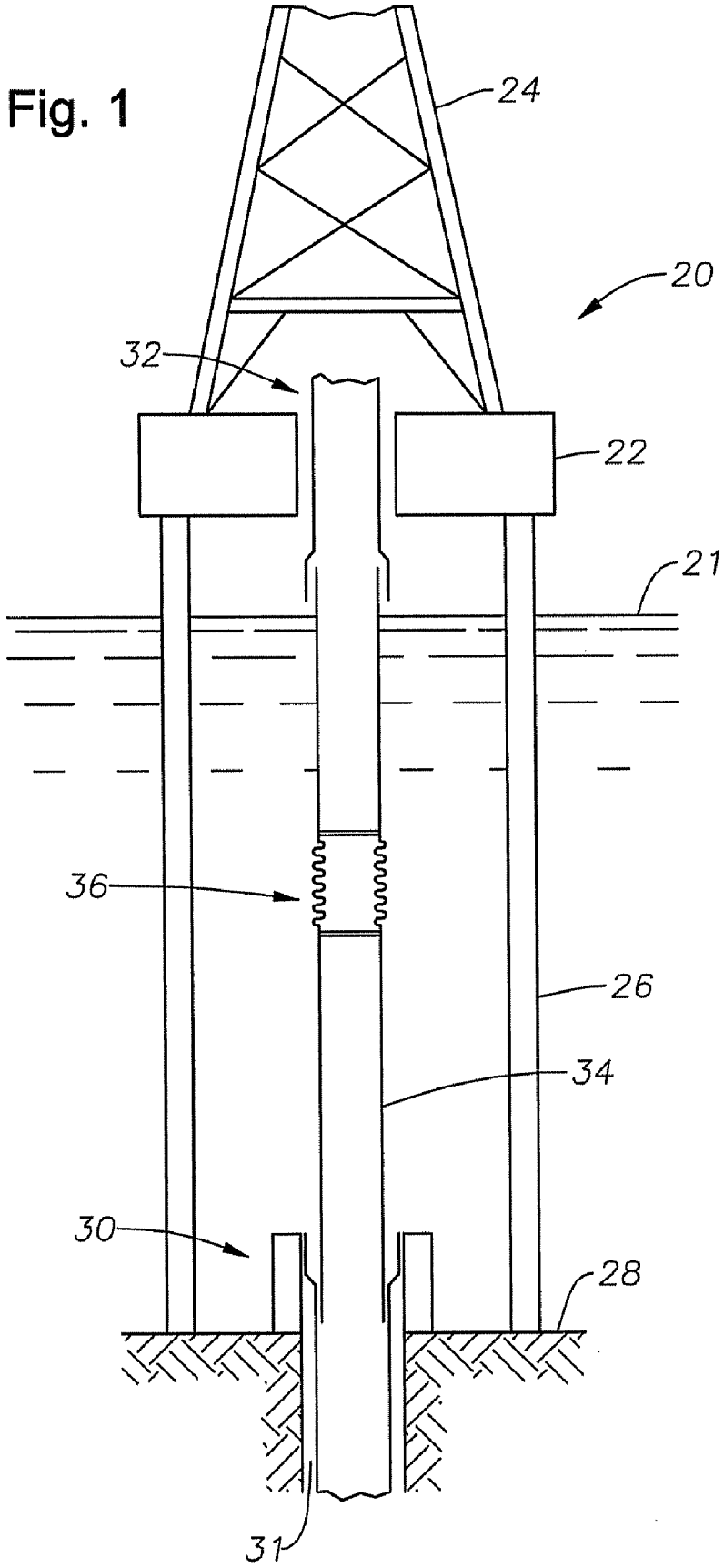
FIG. 1 is a side view of an offshore platform with a casing string extending to the seafloor, the casing string having a tensioning device.

With reference now to FIG. 1, provided therein is an example of an offshore platform 20 in a side view. The offshore platform 20 comprises a deck 22 situated above the level of the sea surface 21 with a derrick structure 24 attached atop the deck 22. Support legs 26 extend from the bottom of the deck 22 and attach on the sea floor 28. A subsea wellhead 30 is formed over a wellbore 31. A tieback casing string 34 extends upward from the subsea wellhead 30 and is coupled with a surface wellhead 32 disposed within the deck 22. In line with the casing string 34 is a tubular compensating member 36. The compensating member 36 may be integrally formed within the tieback casing string 34. Optionally, the compensating member 36 may be formed separately from the tieback casing string 34 and later attached therein such as by a weld, threaded connection, or flanged connection. The compensating member 36 can compensate for tieback casing string 34 length changes while maintaining a substantially constant axial stress in the tieback casing string 34. Alternatively, the compensating member 36 may be connected on one end to the casing string 34 terminal upper or lower end and on its other end to either the surface wellhead 32 or subsea wellhead 30. The compensating member 36 can be coupled with any riser and is not limited to use with a tieback casing string. The compensating member 36 may be exposed to the seawater or may be enclosed inside additional casing strings. Other examples include tubing, subsea transfer lines, subsea flowline connections, and tubular members inserted within a wellbore.

The compensating member 36 is axially compressive or axially expandable in response to an applied axial force. The member 36 compresses or expands depending on the magnitude of the applied force and its direction. As noted above, a tieback casing string 34 typically remains in tension during operation. Accordingly, the member 36 can be compressed in response to casing string 34 (or other riser) elongation without removing tension from the casing string 34.

Figure 2:
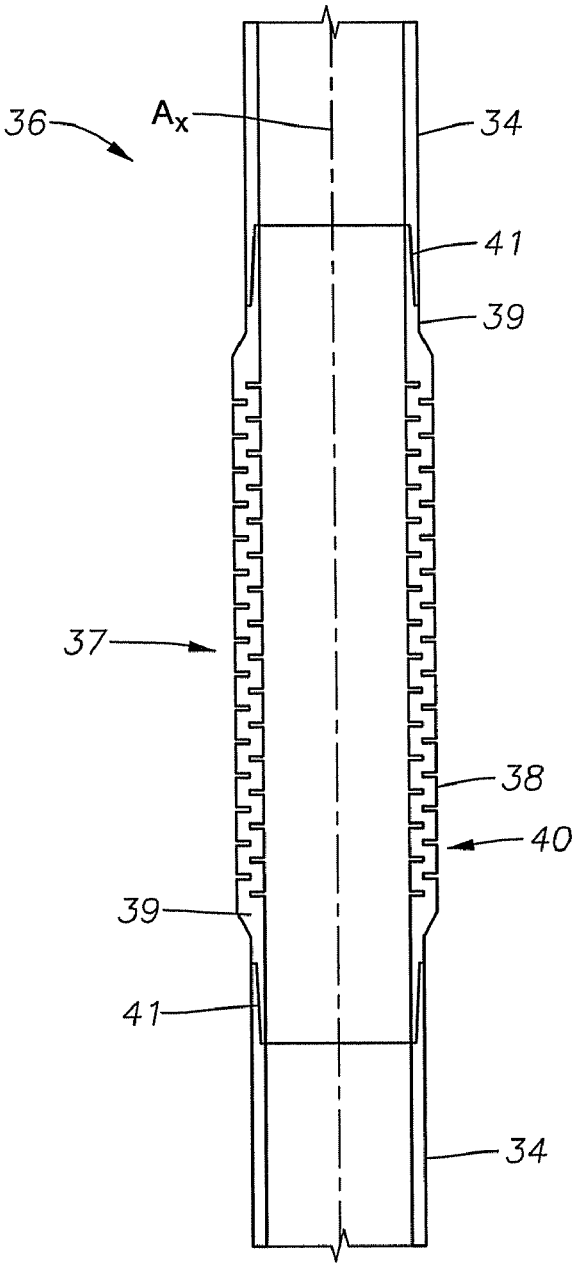
FIG. 2 is a side cutaway view of an embodiment of a tensioning device.

With reference now to FIG. 2, illustrated therein is a sectional view of an embodiment of the compensating member 36. In this embodiment, the compensating member 36 includes a body 37 and leads 39. The leads 39 extend from opposite ends of the body 37 for connecting the body 37 to the casing string 34. Threaded connections 41 are shown on the free end of the leads 39; however welds or flanges could be used for connecting to the casing string 34. When formed integral with the casing string 34, the compensating member 36 may optionally not include specific connections to the casing string 34. The body 37 transitions from a smaller thickness adjacent the leads 39 to a larger thickness along its mid portion to form a wall 38 between the transitions. The wall 38 cross section is contoured in a repeating "S" or "Z" shaped pattern. The pattern may be created by forming slots 40 into the inner and outer circumference of the wall 38. Strategically alternating the slots 40 between the wall 38 inner surface and wall 38 outer surface along the body 37 axis $A_X$ forms the "S"/"Z" shaped pattern.

Figure 3:
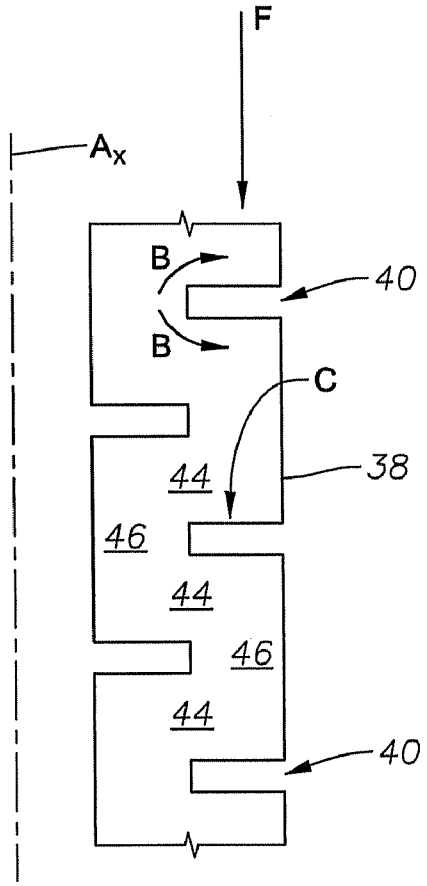
FIG. 3 depicts an enlarged portion of the tensioning device of FIG. 2.

Incorporating the slots 40 alters the wall 38 cross sectional structure. As illustrated in an enlarged view in FIG. 3, the wall 38 cross section comprises a series of members 44 each having a web element 46 from each end and extending therefrom in an opposite direction. The member 44 to web element 46 connection is analogous to a cantilever connection C. The members 44 are shown aligned substantially parallel to one another arranged perpendicular to the web elements 46 and the body 37 axis $A_X$. However other embodiments exist wherein one or more members 44 are arranged oblique to one or more of the other members 44, oblique to one or more of the web elements 46, or oblique to the body 37 axis $A_X$. Optionally, one or more web elements 46 may be oblique to the body 37 axis $A_X$.

Unlike a solid tubular, an axial force F initially applied to the wall 38 does not produce an evenly distributed stress across the wall thickness. Instead the resulting stress concentrates at the cantilevered connections C between the member 44 and web element 46 thereby exerting a bending moment B about the connection C. A sufficient bending moment B on a member 44 deflects the member 44 toward an adjacent slot 40 that in turn shortens the wall 38 and member 36 length. Similarly, an axial force applied in a direction opposite to the force F produces oppositely oriented bending moments that increase the slot 40 width to lengthen the member 36. It should be pointed out that the compensating member 36 configuration described herein is designed to deflect, either in compression or tension, before applied forces approach the yield strength of the casing string 34 or other components. As such, the compensating member 36 expands or compresses at a linear increment less than the linear expansion/compression of the riser.

Due to the dynamic nature of the expanding and contracting casing string 34, the wall 38 material should be sufficiently elastically deformable to accommodate such dynamic loading. As is known, the number of members 44 deflecting, and by how much depends on the force F magnitude, the wall 38 and slot 40 dimensions, and wall 38 material. Thus the body 37 material, slot 40 dimensions, number of slots 40, and wall 38 thickness depend on the anticipated tieback attachment operating conditions. However, those skilled in the art are capable of estimating these variables. In the embodiment shown, the body 37 primarily comprises a single member thereby having a uni-body construction. In this embodiment, the body 37 itself expands and contracts to maintain riser tension without relative movement between two or more coupled members.

Figure 4:
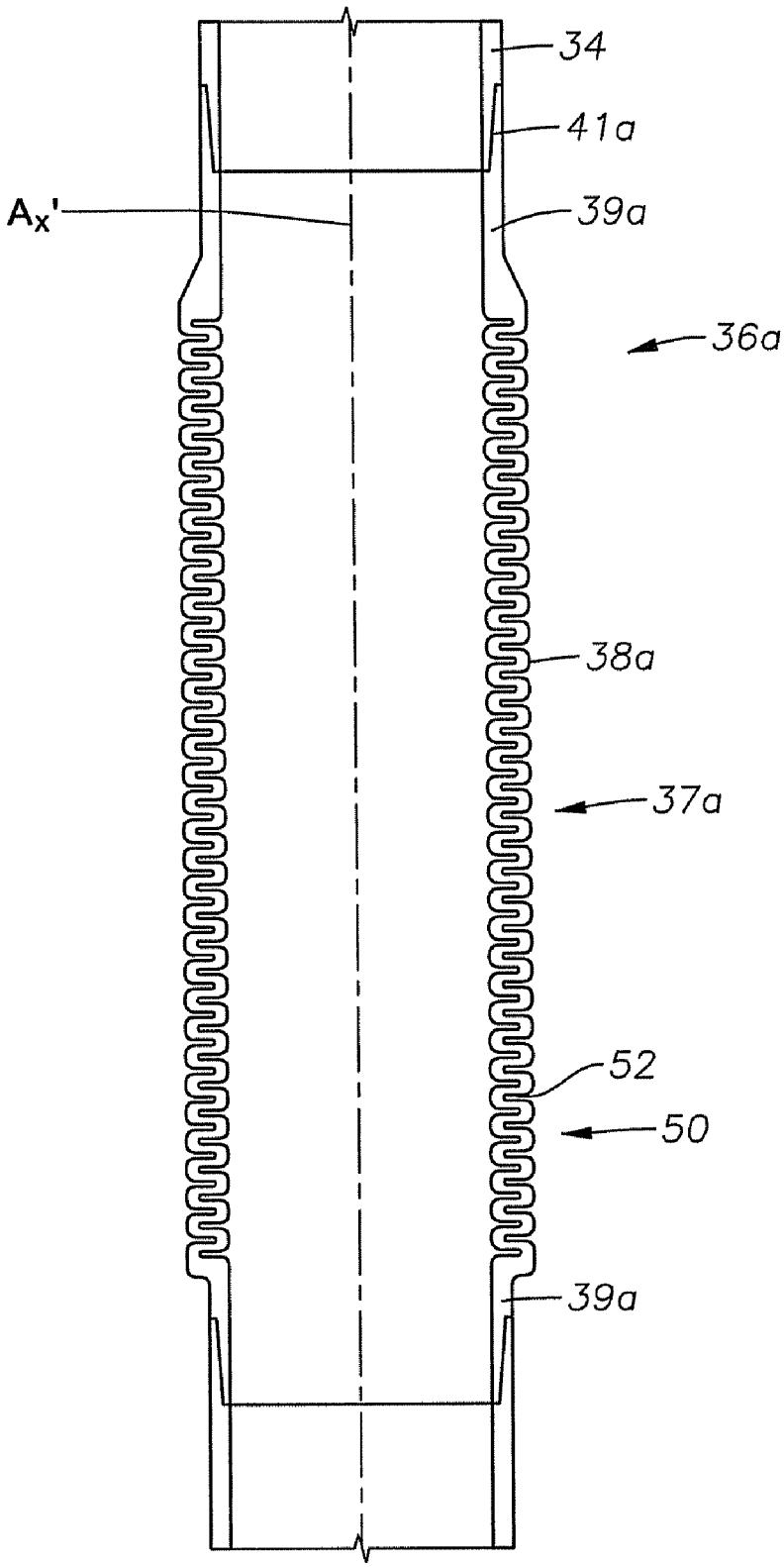
FIG. 4 is a side cutaway view of an alternative embodiment of a tensioning device

FIG. 4 depicts an alternative compensating member **36*a* in a side sectional view. In this embodiment, the compensating member 36*a* includes a body 37*a*, leads 39*a* for attaching the body 37*a* to the casing string 34, and a wall 38*a* between transitions adjacent the leads 39*a*. In this embodiment the wall 38*a* cross section illustrates a series of folds resembling a repeating series of undulations 50. The undulations 50 have a generally "U" shaped cross section comprising a first and second portion oriented generally perpendicular to the body 37*a* axis $A_x$' joined by a base portion, where the base portion runs generally parallel to the body 37*a* axis $A_x$'. Spaces 52** are defined in the area between each respective first and second portion.

Referring still to FIG. 4, the folds circumscribe the body **37*a* axis $A_X$' in annular sections sequentially stacked along the body 37*a* length; the annular sections lie in a plane substantially perpendicular to the axis $A_X$'. Similar to the wall 38 of FIG. 2, the wall 38*a* of FIG. 4 can respond to the expansion or contraction of the casing string 34 by correspondingly expanding or contracting while retaining sufficient tension in the casing string 34. Alternatively the compensating member 36*a* wall 38*a* of FIG. 4 is formed into a bellows or bellows like structure. In another embodiment, the folds are formed by a pair of axially spaced apart helixes axially formed in the inner and outer wall 38*a* circumference. The helixes circumferentially traverse the body 37*a*** extending between the transitions.

Figure 5:
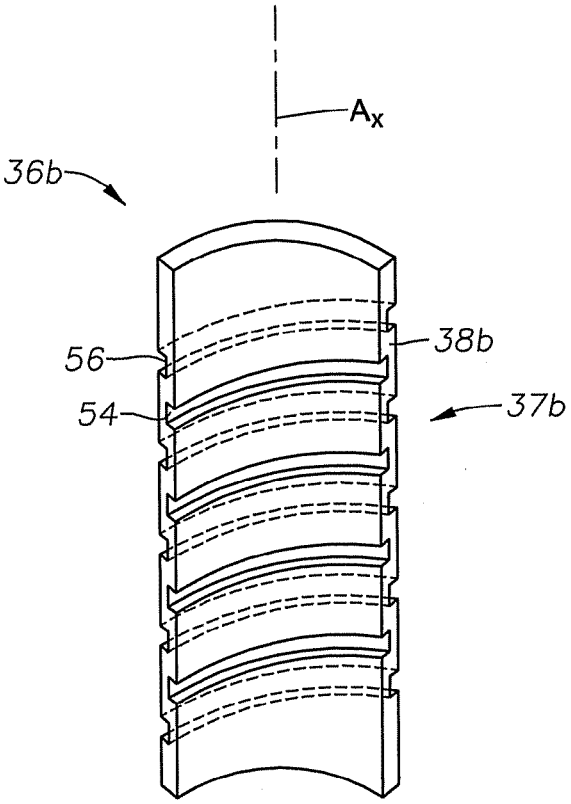
FIG. 5 is a sectional perspective view of an alternative embodiment of a tensioning device.

Shown in a sectional perspective view in FIG. 5 is a portion of another embodiment of a motion compensation member **36*b*. In this embodiment helical grooves 54, 56 are formed along the body 37*b*. More specifically, an inner helical groove 54 is formed on the inner surface of the wall 38*b* with a corresponding outer helical groove 56 formed along the wall 38*b* outer surface. The grooves 54. 56 are shown staggered along the member 36*b* axis $A_X$ thereby forming an "S" or "Z" shaped cross section similar to the embodiment of FIG. 2. Embodiments exist having a single helical groove either on the inner or outer wall 38*b* surface. Optionally, the body 37*b*** could comprise multiple helically grooves along its surfaces, i.e. inner, outer, or both.

Figure 6:
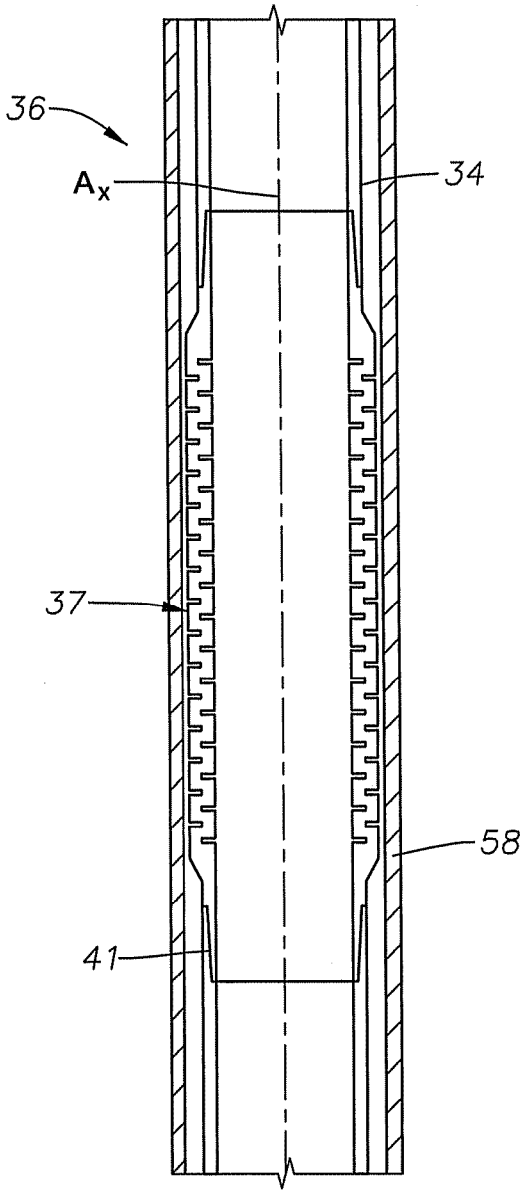
FIG. 6 is a side sectional view of an embodiment of a tensioning device having an outer support sleeve.

FIG. 6 depicts an optional support sleeve 58 circumscribing the body 37. The support sleeve 58 may be included to add structural support to the motion compensation member 36, especially loading tangential to the axis $A_X$. The support sleeve 58 may comprise a single tubular member or multiple elements disposed along the body 37. The sleeve 58 may be comprised of any material capable of adding strength to the body 37, examples include steel, alloys, and composite materials. The sleeve 58 is preferably secured on its upper end to the, surface wellhead 32, to the platform 22, to the tieback string 34 between the body 37 and the surface wellhead 32, or to another similar structure. Optionally, the sleeve 58 can be anchored at its bottom end to the wellhead 30, tieback string 34 between the body 37 and the wellhead 30, or another similar structure.

In one example of use of the device described herein, casing string 34 and compensating member 36 are affixed between seafloor wellhead 30 and surface wellhead 32 and axially tensioned. Sufficient tension in the compensating member 36, 36*a* elastically deforms the wall 38, 38*a* and increases the slot/space 40, 52 thickness that in turn elastically elongates the compensating member 36. Since the compensating member 36, 36*a* is elastically deformed, the compensating member 36, 36*a* can compress to a less elongated state and compensate for casing string 34 elongation due to high temperature fluid exposure. Optionally, the actual tension applied to the casing string 34 and compensating member 36, 36*a* may exceed the required casing string 34 stabilizing value. Thus the casing string 34 tension can remain above its required value after any tension force reduction experienced by compensating member 36 compression.

One of the advantages presented by the compensating member described herein is that it can be comprised of a single member formed into a uni-body construction. Moreover, each of the compensating member embodiments presented are formable into a single unit. The uni-body construction eliminates additional components that can complicate manufacture as well as increase failure modes and percentages of failure.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

What is claimed is:

1. A subsea well production assembly, comprising:

a subsea wellhead;

a well production casing assembly having one end connected to the subsea wellhead and comprising:

an upper casing string;

a lower casing string; and a tubular compensating member comprising an upper end connected to a lower end of the upper casing string, a lower end connected to an upper end of the lower casing string, and a steel body having a wall with undulation that are changeable between a compressed configuration and an elongate configuration; wherein the undulations in the wall comprise a series of helical slots along a length of the wall alternatingly formed about an inner circumference and about an outer circumference of the wall, each helical slot lying in a plane substantially perpendicular to an axis of the compensating member, the helical slots defining a series of cantilevers along a length of the body that are bendable when the body is axially compressed and that are bendable when the body is axially elongated; and the upper casing string is supported in tension, and the body transmits the tension to the lower casing string.

2. The assembly of claim 1, wherein the cantilevers in the wall comprise annular foldable segments coaxially stacked along an axis of the compensating member.

3. The assembly of claim 2, wherein the foldable segments have an "S"shaped cross section.

4. The assembly of claim 1, wherein said one end of the production casing assembly comprises a lower end, and wherein an upper end of the production casing assembly supported by a platform.

5. The assembly of claim 1, wherein the helical slots in the wall comprise helical grooves.

6. The assembly of claim 1 further comprising an upper lead portion on the upper end of the compensating member and a lower lead portion on the lower end of the compensating member the upper and lower portions being cylindrical members having threads that are connected to the upper casing string and the lower casing sring.

7. The assembly of claim 6, wherein the compensating member axially expands and contracts an amount greater per linear increment than the lead portions.

8. The assembly of claim 1 further comprising a support sleeve circumscribing at least a portion of the compensating member, the support sleeve being free of any of the tension transmitted from the casing string to the lower casing string.

9. A compensating casing sub for attachment into a well casing string that connects to a subsea wellhead assembly, the compensating casing sub comprising:

a steel tubular body having an axis and a cylindrical wall concentric with the axis;

a plurality of circumferentially extending annular helical inner slots formed within an inner diameter surface of the wall, and a plurality of circumferentially extending annular helical outer slots formed within an outer diameter surface of the wall and alternating axially with the helical inner slots, the helical inner and helical outer slots defining a series of cantilevers along a length of the body that are bendable when the body is axially compressed and bendable when the body is axially elongated;

each of the helical inner and helical outer slots being rectangular when viewed in transverse cross-section and located in a plane substantially perpendicular to the axis; and a set of threads on each end of the body for connecting to upper and lower sections of the well casing string.

10. The compensating casing sub of claim 9, wherein the wall has a greater thickness between the inner and outer diameter surface that portion of the sub containing the threads.

11. A method of making up a production casing for a subsea well, comprising:

providing an upper casing string and a lower casing string;

providing a compensating member having a steel body with a cylindrical wall having a series of helical slots along a length of the wall alternatingly formed about an inner circumference and an outer circumference of the wall, each helical slot lying in a plane substantially perpendicular to an axis of the compensating member, the helical slots defining a series of cantilevers along a length of the body that are bendable when the body is axially compressed and that are bendable when the body is axially elongated;

connecting upper and lower ends of the compensating member in the series between the upper and lower casing strings, defining a casing string assembly;

connecting one end of the casing string, assembly to a subsea wellhead; and applying tension to the upper casing string and transmitting the tension through the body of the compensating member to the lower casing string.

12. The method of clam 11, wherein when one of the upper and lower casing strings elongates, the compensating member compresses and wherein when one of the upper and lower casing strings compresses, the compensating member elongates.

13. The method of claim 11 wherein the cantilevers in the tubular wall comprise foldable segments.

14. The method of claim 11,wherein:

connecting one of the ends of the easing string assembly to the subsea wellhead comprises connecting, a lower end of the casing string assembly to the subsea wellhead; and the method further comprises:

connecting an upper end of the casing string assembly to a platform.

* * * * *